US006151868A

United States Patent [19]

Matthews

[11] Patent Number: 6,151,868

[45] Date of Patent: Nov. 28, 2000

[54] TRANSVERSE DIRECTION ZIPPER ATTACHING APPARATUS AND METHOD

[75] Inventor: David J. Matthews, Gilman, Ill.

[73] Assignee: Illinois Tool Works, Inc., Glenview, Ill.

[21] Appl. No.: 09/234,174

[22] Filed: Jan. 19, 1999

[51] Int. Cl.[7] ..... B65B 9/00; B65B 61/18

[52] U.S. Cl. ..... 53/451; 53/412; 53/554; 53/133.4; 53/139.2

[58] Field of Search ..... 53/450, 451, 550, 53/551, 554, 133.4, 139.2, 412; 493/213

[56] References Cited

U.S. PATENT DOCUMENTS

| | | | |
|---|---|---|---|
| 4,620,320 | 10/1986 | Sullivan | 53/133.4 |
| 4,909,017 | 3/1990 | McMahon et al. | 53/133.4 |
| 5,400,565 | 3/1995 | Terminella et al. | 53/133.4 |
| 5,400,568 | 3/1995 | Kanemitsu et al. | 53/133.4 |
| 5,417,035 | 5/1995 | English | 53/133.4 |
| 5,561,966 | 10/1996 | English | 53/133.4 |
| 5,816,018 | 10/1998 | Bois | 53/133.4 |
| 6,000,197 | 12/1999 | Ausnit | 53/133.4 |
| 6,017,412 | 1/2000 | Van Erden et al. | 53/133.4 |

*Primary Examiner*—Brian L. Johnson
*Assistant Examiner*—Matthew Luby
*Attorney, Agent, or Firm*—Pitney, Hardin, Kipp & Szuch LLP

[57] ABSTRACT

A funnel for a form-fill-seal (FFS) machine configured to make transverse-zippered reclosable packages from a continuous supply of thermoplastic film having a plurality of zipper strips transversely sealed thereto at package length intervals is provided. The funnel includes a lower surface a contoured to keep the zipper profiles substantially parallel to each other as the thermoplastic film is fed over the FFS machine forming collar and folded around the FFS machine filling tube. A method and apparatus for making transverse zippered reclosable packages is also provided.

15 Claims, 4 Drawing Sheets

TRANSVERSE DIRECTION ZIPPER ATTACHING APPARATUS AND METHOD

BACKGROUND OF THE INVENTION

1. Field of the Invention

The present invention relates to reclosable plastic bags and packages of the type in which food products, such as chips and cereal, and other goods may be packaged for sale to consumers. More particularly, the present invention relates to improvements in the art of making reclosable plastic bags on form-fill-seal (FFS) machines wherein the zipper is applied transverse to the running direction of the film from which the bag is formed.

2. Description of the Prior Art

The present invention relates to improvements in the package-making art and may be practiced in the manufacture of thermoplastic bags and packages of the kind that may be used for various consumer products, but which are particularly useful for food products which must be kept in moisture and air-tight packages, free from leakage until initially opened for access to the product contents, which packages are then reclosable by zipper means to protect any remainder of the product therein.

The prior art is fairly well-developed, but nevertheless remains susceptible to improvement contributing to increased efficiency and cost effectiveness.

In particular, the present invention relates to the area of reclosable packaging known as the "transverse zipper". When making a bag with a transverse zipper, the zipper is attached transverse to the longitudinal axis of the material used to make the bag, as opposed to being attached to the bag material parallel to the longitudinal axis. A method and apparatus for making reclosable plastic bags with a transverse zipper is disclosed in U.S. Pat. No. 4,909,017.

A typical prior art FFS machine 10 configured for making transverse-zippered reclosable plastic bags is shown in FIG. 1. Thermoplastic film 12 from which the bags will be formed is paid off from a continuous roll thereof 14 in increments equal to the length of the bags which will ultimately be formed from the film 12 in the FFS machine 10. The longitudinal axis of the film 12 is parallel to the direction of travel of the film 12. Each time the film 12 comes to rest, a zipper strip 16 supplied from a continuous roll 24 is positioned on the film 12 transverse to the longitudinal axis by a positioning device 18, with one profile 20 of the zipper strip 16 on top of the other profile 22 of the zipper strip 16. The positioning device 18 can take any of a variety of forms well-known to those skilled in the reclosable packaging art, such as a vacuum conveyor for pulling the zipper strip 16 across the film 12 and a knife for cutting the zipper strip 16 from the continuous roll thereof 24.

The zipper strip 16 is then initially sealed or tacked to the thermoplastic film 12 by an attaching device 26, such as a pair of heater bars. FIG. 2 shows a cross section of the zipper strip 16 and the film 12 just after the zipper strip 16 has been attached thereto by the attaching device 26. Each profile has a leading flange 28, 29 projecting in the direction of motion of the film 12 and a trailing flange 30, 31 projecting in a direction opposite to its leading flange. The orientation of the profiles depends on which side of the zipper, if any, is particularly adapted to be the opening side. As disclosed in U.S. Pat. No. 4,909,017, the zipper strip 16 has a length approximately equal to half the width of the film 12 and is disposed centrally thereon. The profile flanges are substantially parallel to each other.

After the zipper strip 16 is positioned on the thermoplastic film 12, the attaching device 26 attaches the leading flange 29 of the lower profile 22 to the thermoplastic film 12. A series of zipper strips 16 are thusly initially attached to the thermoplastic film 12 at bag length increments as the thermoplastic film 12 is paid off the continuous roll thereof 14, as shown in FIG. 1. The transverse zipper-equipped film is then fed into the FFS machine 10, where the bags are formed and the final zipper seals are made.

At the FFS machine 10, the thermoplastic film 12 is fed downwardly over a forming collar 34 and folded around a filling tube 36. The edges of the film are brought together and pressed together by a pair of rollers 38. The edges are then sealed together by heater bars 40 to form a longitudinal back seal 42. Contents may then be dropped through the tube 36 into a bag 44 which has a lower seal 46. As discussed below, the lower seal 46 was made when the preceding bag was completed.

After introduction of the contents, the top of the bag is completed by the action of cross seal jaws 48, which perform five substantially simultaneous functions. First, the cross seal jaws 48 finally seal the leading flanges 28, 29 of the profiles to front and back bag walls without sealing the leading flanges 28, 29 to each other. Second, the cross seal jaws 48 seal the trailing flanges 30, 31 of the zipper strip to the front and back bag walls without sealing the trailing flanges 30, 31 to each other. The use of a heat activated adhesive on the flanges facilitates sealing of the flanges to the bag walls without sealing the flanges to each other. Third, the cross seal jaws 48 seal the top of the bag to form a pilfer evident seal 50. Fourth, the cross seal jaws 48 make the lower seal 46 for the succeeding bag. And fifth, the cross seal jaws 48 cut the completed bag 44 from the film 12.

Manufacture of transverse-zippered reclosable bags in accordance with the foregoing, however, has proven problematic. Specifically, because the leading flange 28 of the upper profile 20 is not initially attached to the thermoplastic film 12 by the attaching device 26, the upper leading flange 28 has a tendency to flare out as the film enters the FFS machine and is fed over the forming collar 34, as shown in FIG. 3. The result of this flaring is that the unsecured upper leading flange 28 has a tendency to either jam the FFS machine or to become caught on the machine and thereby cause the upper profile 20 to detach from the lower profile 22.

While the zipper strip 16 can be made without a leading flange 28 on the upper profile 20 in order to avoid this problem, the absence of the upper leading flange and its subsequent attachment to one of the bag walls in the FFS machine can result in poor zipper opening mechanics and a weak seal between the zipper strip and the completed bag. A four-flange seal, where all four zipper flanges are sealed to the bag, is the best and most secure method of attaching the zipper.

SUMMARY OF THE INVENTION

It is, therefore, the object of the present invention to overcome the aforementioned flaring problem so that zipper strips having four flanges can be used to reliably and efficiently make transverse-zippered reclosable bags on FFS machines.

The present invention achieves the aforementioned object by providing a funnel which is attached to the FFS machine filling tube above the forming collar. The funnel guides the upper profile as the transverse zipper-equipped thermoplastic film is fed over the forming collar and wrapped around the filling tube, thus preventing the upper leading flange from flaring out.

The present invention will now be described in more complete detail with frequent reference being made to the figures identified below in which identical numerals represent identical elements.

DETAILED DESCRIPTION OF THE PREFERRED EMBODIMENTS

Figure 1:
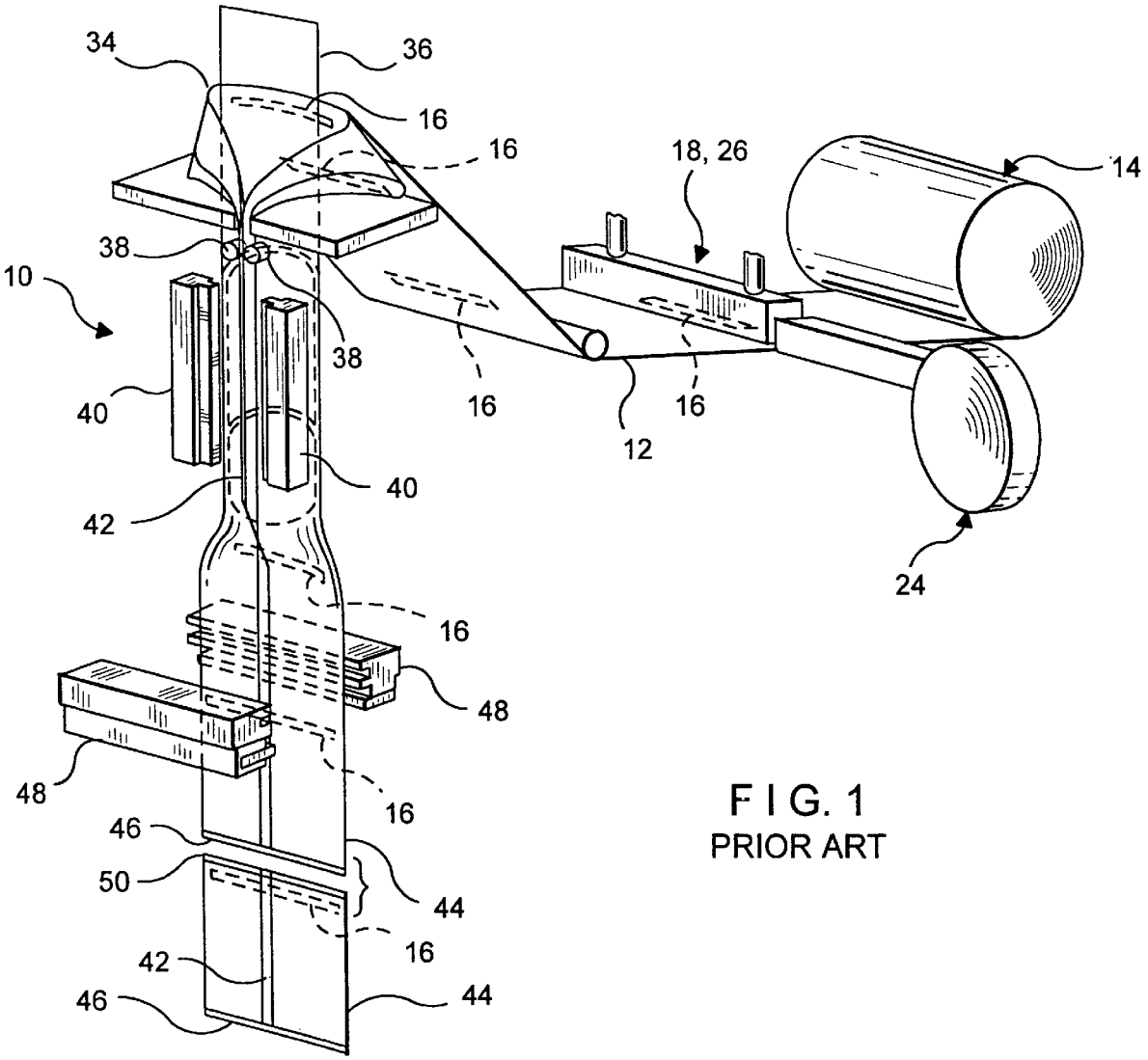
FIG. 1 PRIOR ART
FIG. 1 is a perspective view of a typical prior art FFS machine configured to make transverse-zippered reclosable bags.
Figure 2:
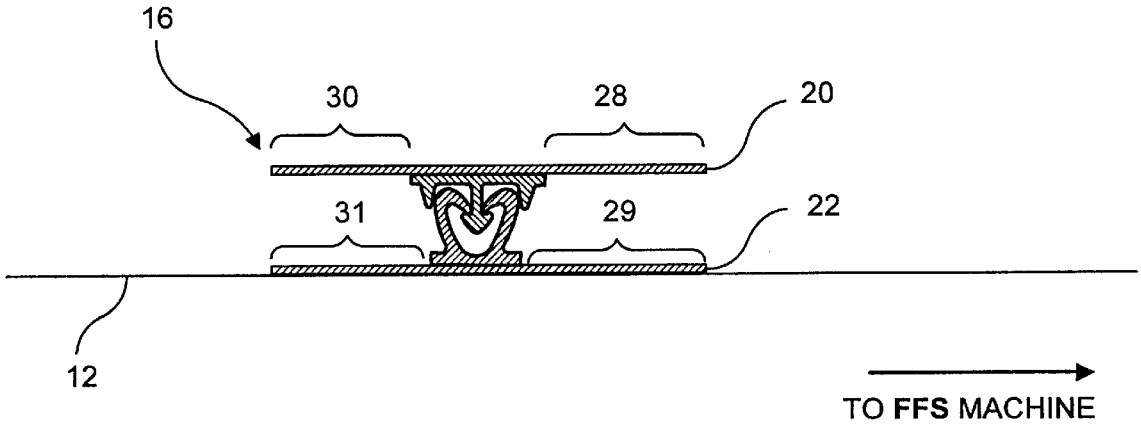
FIG. 2 PRIOR ART
FIG. 2 is a cross-sectional view of a zipper strip initially attached to thermoplastic film before the thermoplastic film is fed into the FFS machine of FIG. 1.
Figure 3:
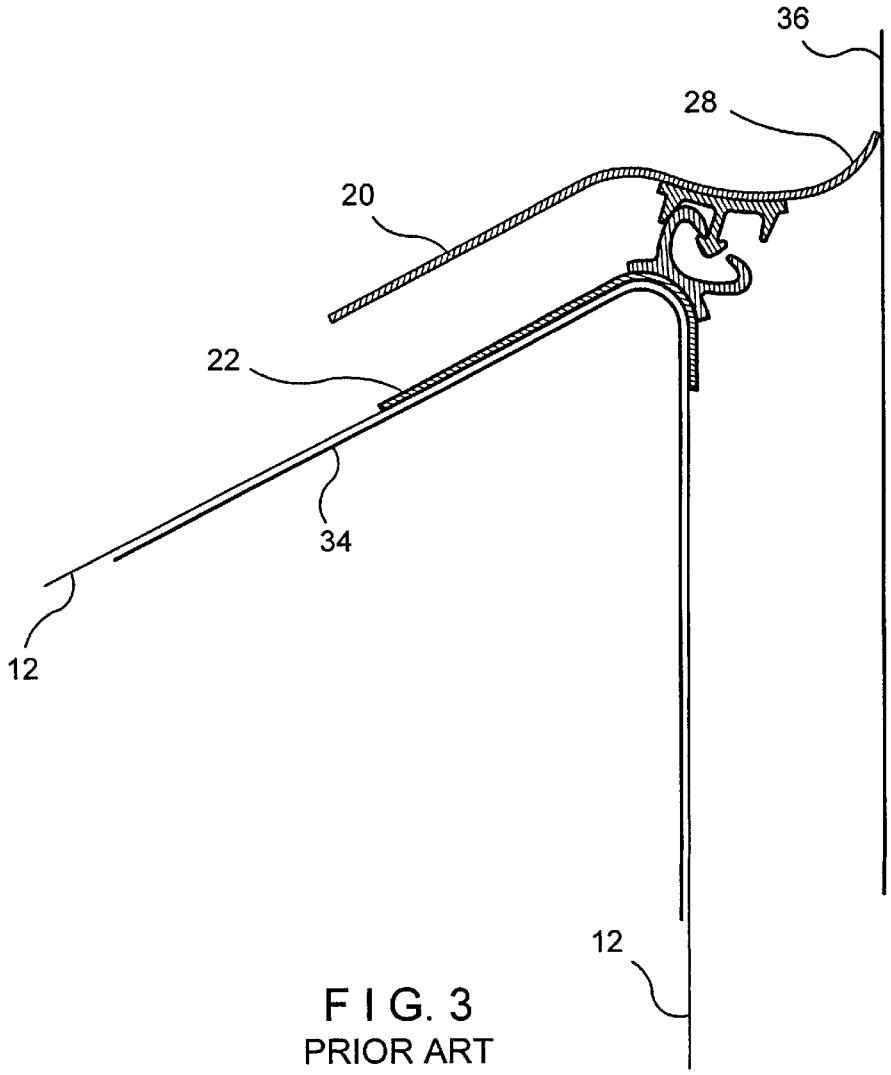
FIG. 3 PRIOR ART
FIG. 3 is a cross-sectional view of a prior art FFS machine forming collar and filling tube which illustrates the flaring problem commonly found in prior art FFS machines.
Figure 4:
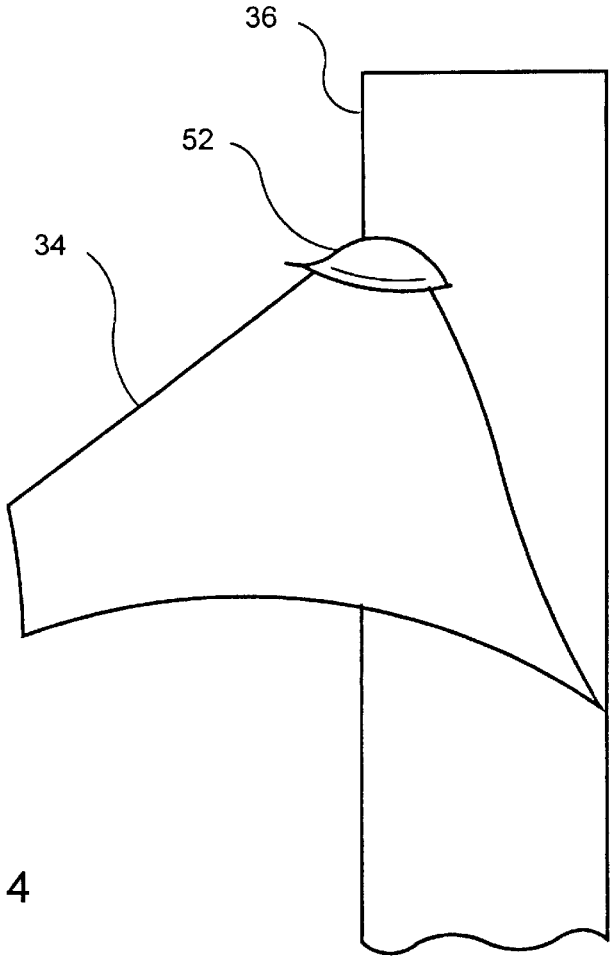
FIG. 4 is a perspective view of a funnel in accordance with the present invention attached to an FFS machine filling tube.

FIG. 4 shows a perspective view of the forming collar 34 and filling tube 36 of a typical FFS machine, such as the FFS machine of FIG. 1. In accordance with the present invention, a funnel 52 is attached to the filling tube 36 above the forming collar 34.

Figure 5:
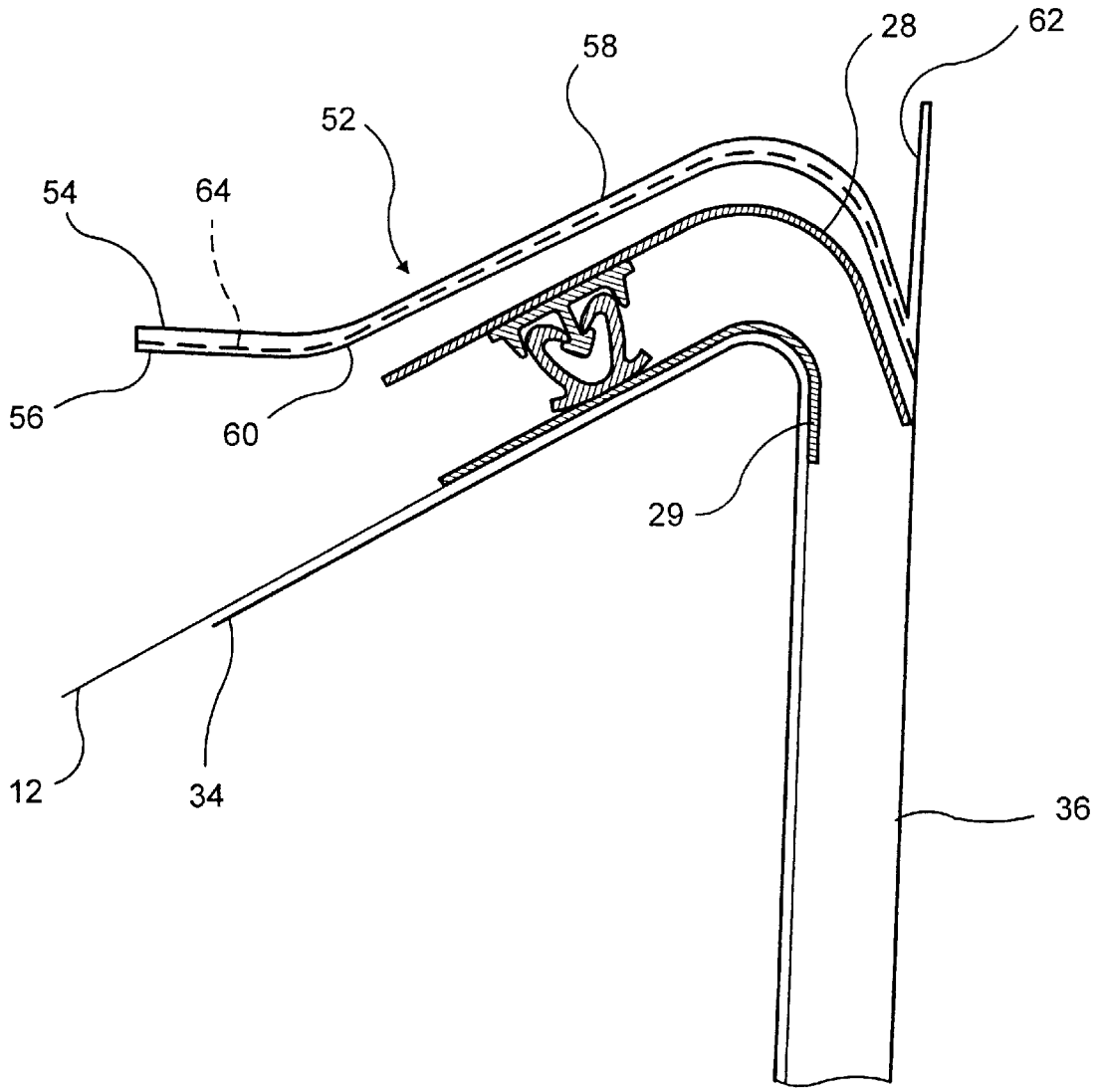
FIG. 5 is a cross-sectional view of an FFS machine forming collar, filling tube and funnel in accordance with the present invention.

As shown in detail in FIG. 5, which shows a cross section of the forming collar 34, filling tube 36 and funnel 52 of FIG. 4, the funnel 52 is shaped to guide the upper leading zipper flange 28 over the forming collar 34 so as to maintain the substantial parallelism of the upper leading flange 28 and the lower leading flange 29. In this manner, the upper leading flange 28 is prevented from flaring out and jamming the FFS machine or getting caught in the FFS machine and causing the upper profile 20 to detach from the lower profile 22 as the thermoplastic film 12 is fed over the forming collar 34 and around the filling tube 36.

The funnel 52 is provided with a skirt 54 having a lower surface 56 for correcting any initial flaring of the upper leading flange 28 which may have been present during the initial attachment of the zipper strip 16 to the thermoplastic film 12; a main body 58 having a lower surface 60 which follows the shape of the forming collar 34 and which guides the upper leading flange 28 over the forming collar 34; and a base 62 for attaching the funnel 52 to the filling tube 36.

Figure 6:
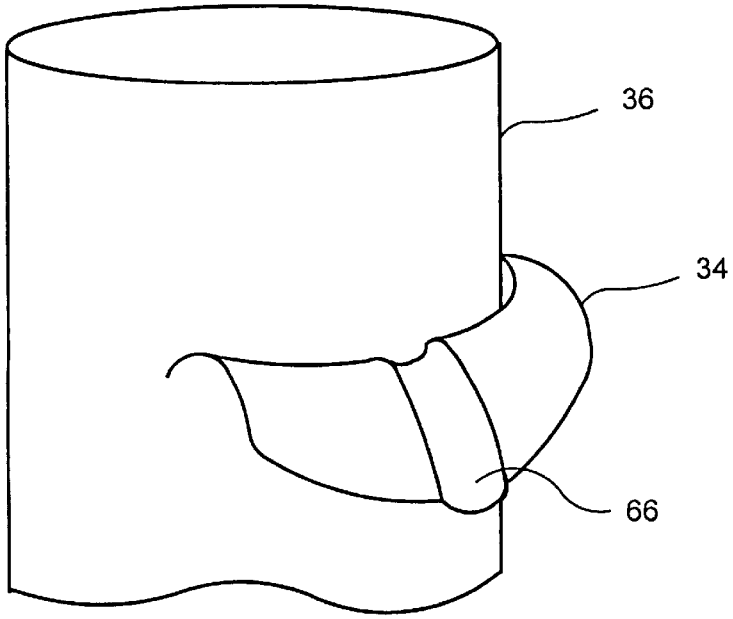
FIG. 6 is a perspective view of an FFS machine forming collar and filling tube in accordance with the present invention.

In those situations where the zipper strip 16 is provided with a slider to facilitate the opening and closing of the zipper strip 16, a groove 64 may be provided in the lower surface 56, 60 of the funnel 52 for guiding the slider. Alternatively, a groove 66 may be provided in the forming collar 34, as shown in FIG. 6 in place of or in addition to the groove 64. Further, even if one or both of the front flanges of the zipper profiles were eliminated (as may be possible in the case of a zipper provided with a slider), the funnel 52 would assist in maintaining the parallelism of the upper and lower profiles as the film material passes over the forming collar.

An FFS machine modified in accordance with FIGS. 4 and 5 operates identically to the FFS machine of FIG. 1, with the exception of the guiding action provided by the funnel 52.

Thus, the thermoplastic film 12 is paid off from the continuous roll thereof 14 in increments equal to the length of the bags which will ultimately be formed from the film 12 in the FFS machine 10. Each time the film 12 comes to rest, a zipper strip 16 is positioned on the film 12 transverse to the longitudinal axis by the positioning device 18 with the upper profile 20 on top of the lower profile 22. The zipper strip 16 is then initially attached to the thermoplastic film 12 by the attaching device 26 by sealing or tacking the lower leading flange 29 thereto.

At the FFS machine 10, the thermoplastic film 12 is fed downwardly over the forming collar 34 and folded around filling tube 36, with the upper leading flange 28 of each zipper strip 16 being guided by the funnel 52 so that the upper leading flange 28 does not flare out and jam the machine or cause the profiles to detach from one another.

The edges of the film are then brought together and pressed together by the rollers 38 and welded together by the heater bars 40 to form the longitudinal back seal 42. Contents may then be dropped through the tube 36.

After introduction of the contents, the top of the bag is completed by the action of cross seal jaws 48, which (1) finally seal the leading flanges 28, 29 of the profiles to front and back bag walls without sealing the leading flanges 28, 29 to each other; (2) seal the trailing flanges 30, 31 of the zipper strip to the front and back bag walls without sealing the trailing flanges 30, 31 to each other; (3) seal the top of the bag to form a pilfer evident seal 50; (4) make the lower seal 46 for the succeeding bag; and (5) cut the completed bag 44 from the film 12.

Thus, through use of the funnel of the present invention, zipper strips having four flanges may be reliably and efficiently used to make transverse-zippered reclosable bags on FFS machines.

Modifications to the above would be obvious to those of ordinary skill in the art, but would not bring the invention so modified beyond the scope of the appended claims.

What is claimed is:

1. An apparatus for making reclosable packages comprising:

means for advancing thermoplastic film having a longitudinal axis along said axis in amounts equal in length to that of said packages;

means for disposing a length of zipper strip having first and second interlocking profiles upon said film transversely to said longitudinal axis with one of said profiles positioned substantially parallel to and above the other;

means for attaching the lower of said profiles to said thermoplastic film;

a forming collar downstream of said attaching means over which said thermoplastic film and profiles is fed and a filling tube about which said thermoplastic film is folded so as to bring longitudinal edges of said film together to form front and back package walls; and means for guiding the upper of said profiles as said thermoplastic film is fed over said forming collar and folded around said filling tube so as to maintain said substantial parallelism of said upper and lower profiles.

2. The apparatus in accordance with claim 1 wherein said profiles each include at least one flange and said guiding means guides said upper profile so as to maintain the substantial parallelism of said at least one flanges of said upper and lower profiles.

3. The apparatus according to claim 1 further comprising:

means for sealing said longitudinal edges together; means for cross sealing said package walls to each other above said zipper strip to form the bottom end of a succeeding package; and means for cutting said thermoplastic film between said cross seal and said zipper strip to separate a completed package from said thermoplastic film.

4. The apparatus according to claim 1 wherein said guiding means includes a funnel positioned above said forming collar, said funnel having a lower surface contoured to guide said upper profile in said substantial parallelism.

5. The apparatus according to claim 4 further comprising means for guiding a slider provided on said zipper strip as said upper profile is guided by said funnel.

6. The apparatus according to claim 5 wherein said slider guiding means comprises a groove in said forming collar.

7. The apparatus according to claim 5 wherein said slider guiding means comprises a groove in said funnel lower surface.

8. A method of making reclosable packages on a form-fillseal (FFS) machine comprising the steps of:

providing thermoplastic film having a longitudinal axis and advancing said thermoplastic film longitudinally in amounts equal in length to that of said packages;

providing a length of zipper strip having first and second interlocking profiles substantially parallel with each other;

disposing said length of zipper strip upon said film transversely to said longitudinal axis with one of said profiles positioned above the other;

attaching the lower of said profiles to said thermoplastic film;

feeding said thermoplastic film and profiles over a forming collar of said FFS machine and folding said thermoplastic film around a filling tube of said FFS machine so as to bring longitudinal edges of said film together to form front and back package walls; and guiding the upper of said profiles as said thermoplastic film is fed over said forming collar and folded around said filling tube so as to maintain said substantial parallelism of said upper and lower profiles.

9. The method according to claim 8 comprising the additional steps of:

sealing said longitudinal edges together;

sealing said profiles to opposing inner surfaces of said front and back package walls without sealing said profiles to each other;

cross sealing said package walls to each other above said zipper strip to form the bottom end of a succeeding package; and cutting said thermoplastic film between said cross seal and said zipper strip so as to permit separation of a completed package from said thermoplastic film.

10. The method according to claim 8 wherein said upper and lower profiles each include at least one flange and said guiding step maintains the substantial parallelism of said at least one flanges of said upper and lower profiles.

11. The method according to claim 8 wherein said upper profile is guided by a funnel positioned above said forming collar, said funnel having a lower surface contoured to guide said upper profile in said substantial parallelism.

12. The method according to claim 11 further comprising the step of guiding a slider provided on said zipper strip as said upper profile is guided by said funnel.

13. The method according to claim 12 wherein said slider is guided by a groove in said forming collar.

14. The method according to claim 12 wherein said slider is guided by a groove in said funnel lower surface.

15. The method according to claim 8 wherein said advancing film is periodically brought to rest, at which time said length of zipper strip is disposed upon said film.

* * * * *